United States Patent [19]

Alker et al.

[11] Patent Number: 4,823,700

[45] Date of Patent: Apr. 25, 1989

[54] MISSILE WITH REMOTE-CONTROLLED WARHEAD

[75] Inventors: Erich Alker; Walter Diesinger, both of Bergisch Gladbach; Rainer Schöffl, Odenthal, all of Fed. Rep. of Germany

[73] Assignee: Dynamit Nobel Aktiengesellschaft, Troisdorf, Fed. Rep. of Germany

[21] Appl. No.: 109,162

[22] Filed: Oct. 16, 1987

Related U.S. Application Data

[63] Continuation of Ser. No. 723,155, Apr. 15, 1985.

[30] Foreign Application Priority Data

Apr. 17, 1984 [DE] Fed. Rep. of Germany ..... 3414414

[51] Int. Cl.[4] ..... F42B 13/10

[52] U.S. Cl. ..... 102/476; 102/378

[58] Field of Search ..... 102/476, 489, 211, 213, 102/374, 377, 378, 384, 396, 397; 244/3.15, 3.16, 3.19

[56] References Cited

U.S. PATENT DOCUMENTS

| | | | |
|---|---|---|---|
| 2,804,823 | 3/1957 | Jablansky . | |
| 3,070,018 | 12/1962 | Fahl | 102/378 |
| 4,284,007 | 8/1981 | Arnell . | |
| 4,430,943 | 2/1984 | Bock et al. | 102/522 |
| 4,498,393 | 2/1985 | Fischer et al. | 102/387 |
| 4,567,829 | 2/1986 | Ziemba et al. | 102/397 |

FOREIGN PATENT DOCUMENTS

| | | | |
|---|---|---|---|
| 127805 | 5/1984 | European Pat. Off. . | |
| 2545923 | 11/1984 | European Pat. Off. . | |
| 3137198 | 4/1983 | Fed. Rep. of Germany | 102/476 |
| 1187739 | 4/1970 | United Kingdom . | |

OTHER PUBLICATIONS

Maverick Missile Enters New Phase by Philip Geddes, International Defense Review 11/1981, pp. 1463–1468.

*Primary Examiner*—Harold J. Tudor
*Attorney, Agent, or Firm*—Antonelli, Terry & Wands

[57] ABSTRACT

A seeker head and an associated electronic system are mounted to the front end of a warhead in order to guide the missile to the target and to initiate detonation at the right time. To prevent the seeker head and the electronic system from confusing an impeding the hollow-charge jet produced by the hollow charge, the components arranged in front of the warhead are accelerated away from the warhead by a pyrotechnical charge shortly before hitting the target so that the seeker head and electronic system separate from the warhead and the hollow-charge jet produced by the warhead can thus hit the target without obstacle.

17 Claims, 3 Drawing Sheets

MISSILE WITH REMOTE-CONTROLLED WARHEAD

This is a continuation of application Ser. No. 723,155, filed Apr. 15, 1985.

This invention relates to a missile especially a guided missile equipped with a remote-controlled warhead such as a hollow charge or a projectile-forming charge and components arranged in front thereof; e.g., a seeker head and an electronic system, and means for ejecting the components in front of the warhead before the warhead is detonated.

Missiles for combating armored targets normally exhibit warheads acting according to the hollow-charge principle; i.e., those penetrating the target by means of a high-energy beam (hollow charge; shaped charge) or by means of a projectile (P charge=projectile-forming charge; SFF=self-forging fragment). To obtain optimum effect, the warhead must be made to detonate at a specific distance from the target, amounting to about fourfold to tenfold the caliber in case of hollow charges. In this context, no components that can impede the deployment cf the remote effect are allowed to be present in front of the warhead. This condition is difficult to meet in guided missiles since usually a seeker head and the associated electronic system are arranged at the front end of the warhead. A typical example of such a missile has been disclosed, for example, in "Internationale Wehrrevue" (International Military Technology Review), issue 11/1981, page 1464.

It is an object of the invention to provide a missile especially a guided missile wherein the warhead is made to detonate at the prescribed distance before hitting the target without being impeded by otherwise required components.

This object has been attained by providing means for ejecting the components arranged in front of the warhead in the flight direction upon approaching the target before the warhead is being detonated. According to the invention, the components arranged in front of the warhead are ejected or separated from the missile closely in the vicinity of the target. Although this may have the consequence that the missile then no longer receives guidance signals, no corrections of the trajectory are normally to be expected any longer within the target distance range under consideration. In an investigated embodiment wherein a missile approaches the target at 100 m/s, the seeker head would have to be separated at a distance of 3 m from the target to be able to detonate the warhead, 24 ms later, at the optimum distance. It is clearly apparent that within this very brief time period no effective course corrections can any longer be performed, or need to be performed.

The separation of the components arranged in front of the warhead can take place in various ways. Thus, these elements can be disintegrated by an explosive charge, for example, or the elements can be swung out laterally. However, it is more advantageous to move the elements away from the warhead in the axial, i.e. flight direction, in order to avoid interfering forces and/or moments that can cause rotation of the missile about one of the transverse axes. The ejection of the elements in the flight direction can be effected by mechanical power elements, for example a compression spring. However, since it is desirable to move the elements out of the way with maximum speed, against the aerodynamic forces which are, in part, considerable, a pyrotechnical charge is employed with preference.

Embodiments of the invention will be described in greater detail below with reference to the accompanying drawings wherein.

Figure 1:
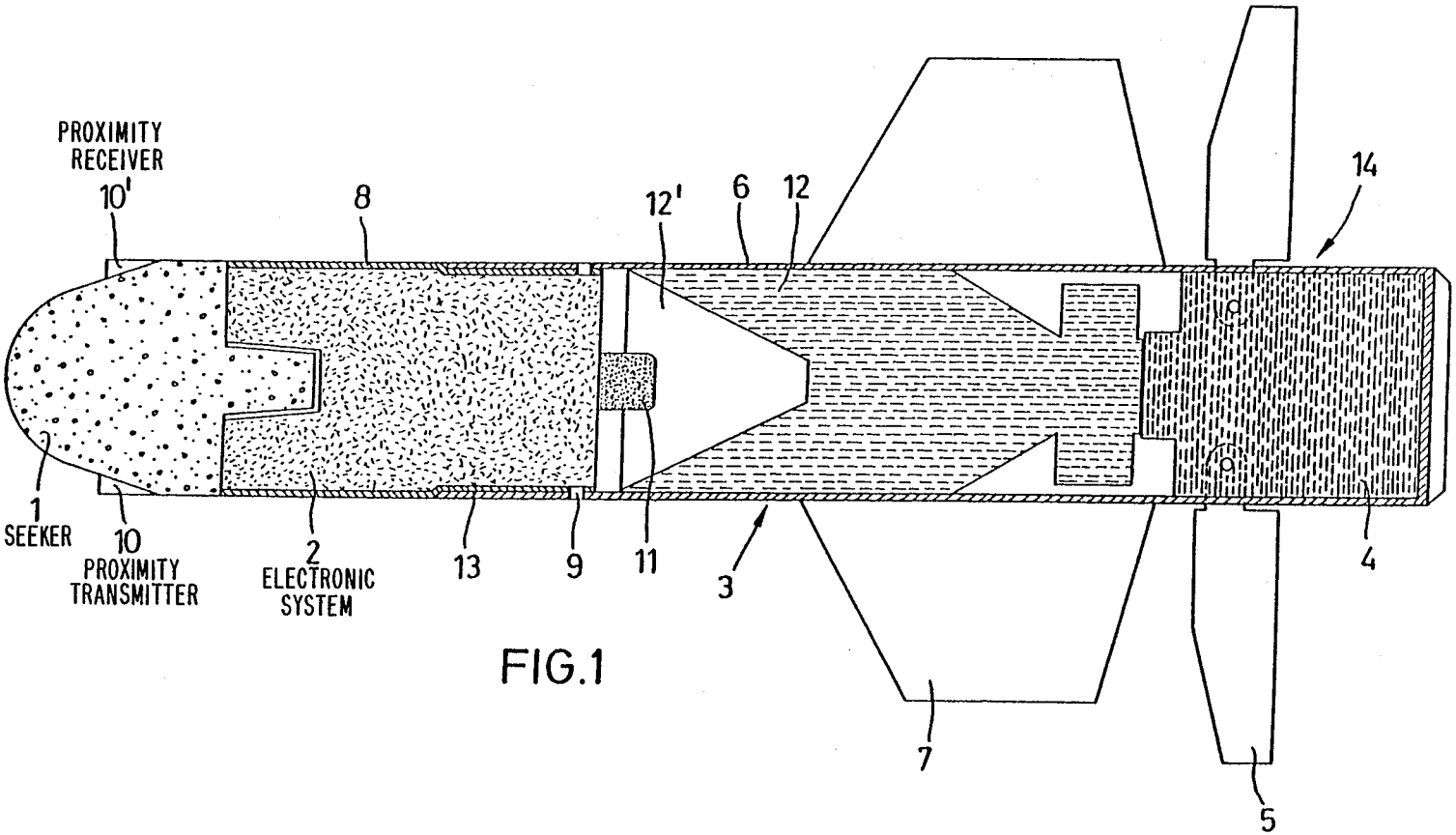
FIG. 1 is a schematic longitudinal section through a guided missile.

The guided missile, shown schematically in FIG. 1, has at the front end a seeker head 1 with an electronic system 2 arranged therebehind, accommodated in a casing 8. The rearward end of the casing 8 is connected with the missile case 6 by means of shear pins 9. The missile case 6 constitutes the jacket of the warhead 3, fashioned in the present case as a hollow-charge head and containing a hollow charge 12; the hollow-charge crater thereof, which is oriented forwardly, is denoted by 12'. The steering section 4 is accommodated in the rearward end of the missile case 6, pivotable rudders 5 projecting therefrom. Furthermore, airfoil wings 7 are attached to the missile case 6. A proximity sensor 10, 10' is mounted at the seeker head 1 and is connected with the electronic system 2. A pyrotechnical charge 11 is arranged at the rear end of the receptacle containing the electronic system 2, this charge in the illustrated embodiment projecting into the hollow-charge crater 12'.

Figures 2, 5:
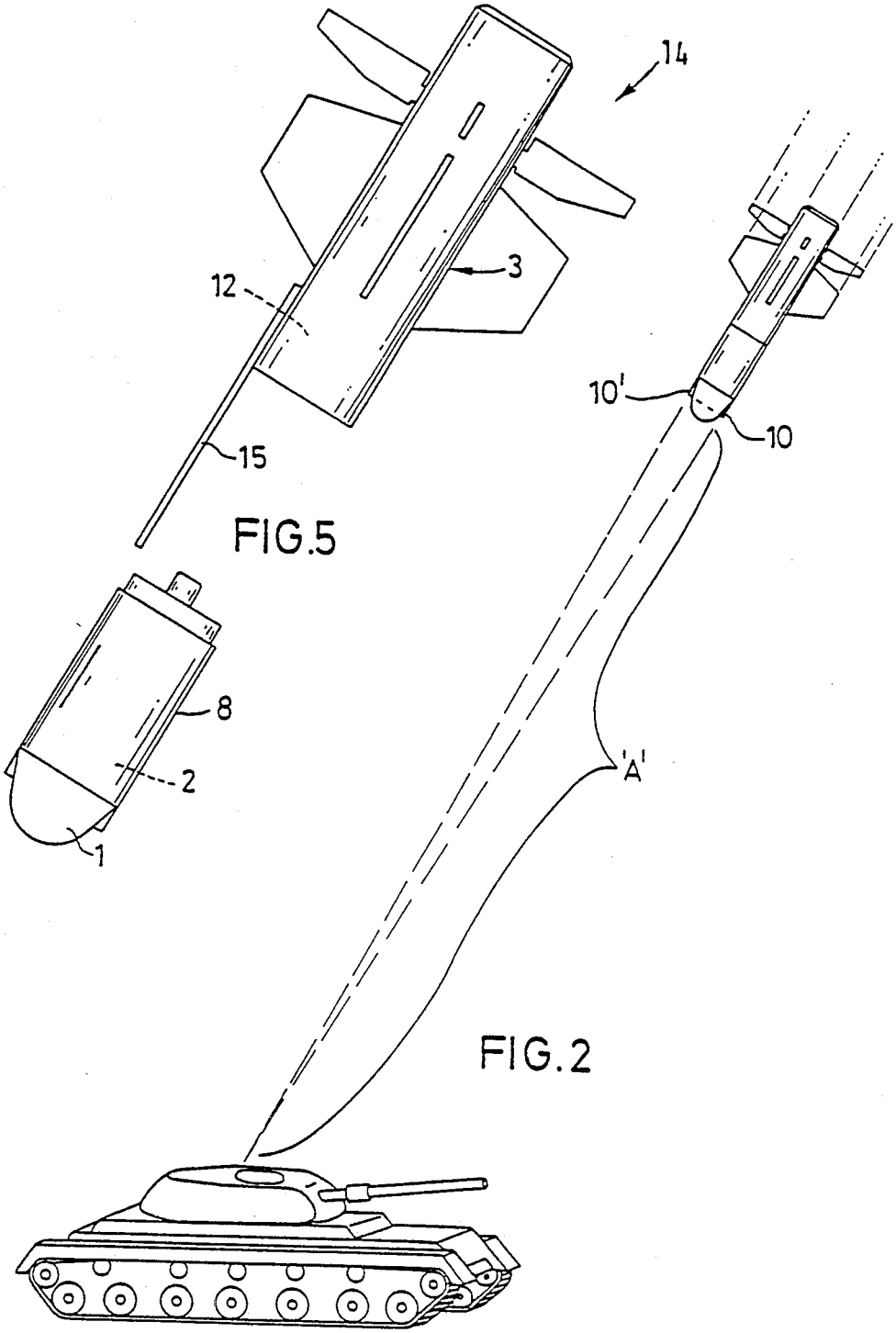
FIG. 2 shows the guided missile approaching the target.
FIG. 5 shows a guided missile with extractable contact feeler.

The proximity sensor 10, 10', designed, for example, as an opto-electronic sensor, comprising a transmitter optic 10 and a receiver optic 10', initiating the pyrotechnical charge 11 in accordance with FIG. 2 upon reaching a fixedly set distance A, using an electronic evaluating unit. The pressure reached by the deflagration of the charge 11 in the hollow-charge crater 12' has the effect that the shear pins 9 are sheared off, and the seeker head 1 with the electronic system 2 are ejected forwardly. The overlapping 13 of the missile case 6 with the frontal casing 8 acts during this process like a piston-type control whereby the ejection velocity is improved.

Figure 3:
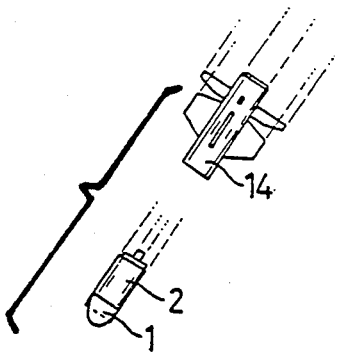
FIG. 3 shows the guided missile after ejection of the seeker head.

FIG. 3 illustrates the missile after ejection of the seeker head 1 with the electronic system 2. These two elements move away from the remaining missile 14 at a relative velocity corresponding to the ejection speed.

Figure 4:
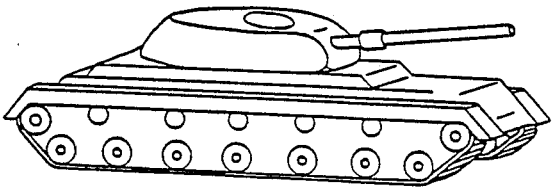
FIG. 4 shows the guided missile at the instant of warhead detonation.
Figure 4:
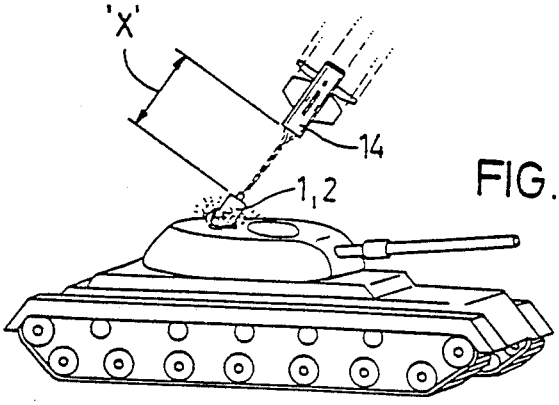

FIG. 4 shows the instant of detonation of the warhead 3 in the remaining missile 14. This instant is chosen so that the spacing X of the warhead from the target corresponds to the optimum distance desired for effect. The seeker head 1 with electronic system 2 has, at this point in time, impinged on the target. Since its partially deformed residues constitute thickening of the target, the optimum distance was calculated from the rear edge of these elements.

In order to move a seeker head weighing 1.6 kg away from the missile at about 30 m/s, 7 g of gunpowder is required as the pyrotechnical charge, as determined by testing.

The improvement attained with respect to the effect of the warhead by means of the solution of this invention can be explained by the following embodiment:

In a guided missile with hollow-charge warhead and seeker head arranged on and in front thereof, the piercing effect in case of armored steel was 2.5 times the caliber. At an optimum distance, without a seeker head arranged in front, the piercing effect could be increased approximately to 8 times the caliber. Even with a diminished piercing effect due to the seeker head separated from and still present between the target and the warhead at the time of warhead detonation, there remains an increase in piercing effect to at least sevenfold the caliber, corresponding to a 2.8-fold improvement.

In the embodiment shown in FIGS. 1–4, it was assumed that the warhead 3 is initiated simultaneously with the pyrotechnical charge 11, and that a pyrotechnical delay retards detonation of the warhead so that it is effective at the optimum distance. This presupposes a substantially constant velocity of the missile in the proximity of the target. Since this will not always be the case, the warhead, in an alternative embodiment, is triggered by a contact feeler.

FIG. 5 shows an embodiment, wherein the ejected seeker head 1 with electronic system 2 pulls a rod-shaped contact sensor out of the remaining missile 14, the length of the contact sensor 15 corresponding to the spacing X required for high-energy penetration.

What is claimed is:

1. A missile, which comprises a missile case; a remote-controlled hollow charge warhead at the forward end of the case; at least one component arranged in front of the warhead for directing the missile to a target; and means for ejecting the at least one component arranged in front of the warhead in the flight direction upon closely approaching the target, before the warhead is detonated to obtain a piercing effect on said target.

2. A missile according to claim I, wherein the means for ejecting the at least one component arranged in front of the warhead consists of a pyrotechnical charge arranged in a casing containing the at least one component.

3. A missile according to claim 2, wherein the pyrotechnical charge is initiated by a non-contactual distance sensor comprising a proximity sensor.

4. A missile according to claim 2, wherein the warhead and the pyrotechnical charge are initiated simultaneously, and the detonation of the warhead occurs in a retarded fashion by a delay member associated with said warhead.

5. A missile according to claim 1, wherein the warhead is triggered by a mechanical distance sensor upon contact of the sensor with the target.

6. A missile according to claim 5, wherein the mechanical distance sensor is placed into its operative position upon ejection of the at least one component.

7. A missile according to claim 3, wherein the warhead and the pyrotechnical charge are initiated simultaneously, and the detonation of the warhead occurs in a retarded fashion by a delay member associated with said warhead.

8. A missile according to claim 1, wherein the at least one component comprises a seeker head and associated electronic system arranged in a casing mounted on to the forward end of the missile case.

9. A missile according to claim 8, wherein the casing is connected to the missile case by shear pins.

10. A missile according to claim 9, wherein said casing also contains a pyrotechnical charge and said means for ejecting the at least one component including a device for igniting said pyrotechnical charge.

11. A missile according to claim I, wherein said missile is a guided missile and said at least one component comprises a seeker head and associated electronic system arranged in a casing mounted onto the forward end of the missile case.

12. A missile according to claim 1, wherein the at least one component is separated from the missile and is free of any mechanical connection with said missile.

13. A missile which comprises a missile case; a hollow charge warhead at the forward end of the case; a seeker head and associated electronic system arranged in a casing mounted onto the forward end of the missile case for directing the missile to a target; and pyrotechnical charge means for ejecting the seeker head and associated electronic system out of a front end of the missile case, said charge means being arranged in front of the warhead for directing the seeker head and associated electronic system in a flight direction along an axial path of said missile when the missile is closely positioned to the target whereby the seeker head and associated electronic system is separated from the missile before the warhead is detonated to achieve a piercing effect on said target.

14. A missile according to claim 13 wherein the warhead is triggered by a mechanical distance sensor upon contact of the sensor with the target and the pyrotechnical charge means are initiated by a proximity sensor.

15. A guided missile having a missile case, a remote-controlled hollow charge warhead located within the case and at least one component arranged in front of the warhead for directing the missile to a target, the improvement wherein means are provided for ejecting the at least on®component arranged in front of the warhead in the flight direction upon closely approaching the target, before the warhead is detonated to obtain a piercing effect on said target; said means for ejecting the at least one component arranged in front of the warhead including a pyrotechnical charge arranged in a casing containing the at least one component, said casing being secured to a section of the missile case containing the remote-controlled hollow charge warhead.

16. A guided missile according to claim 15, wherein the hollow charge warhead is triggered by a mechanical distance sensor upon contact of the sensor with the target.

17. A guided missile according to claim 16, wherein the mechanical distance sensor is placed into an operative position upon ejection of the at least one component in the flight direction, said mechanical distance sensor in its operative position extending forwardly of the hollow charge warhead.

* * * * *